United States Patent [19]

Comtois et al.

[11] Patent Number: 4,849,591

[45] Date of Patent: Jul. 18, 1989

[54] PROTECTION CUTTING APPARATUS PROVIDED WITH AN ARC BREAKING SCREEN

[75] Inventors: Patrick Comtois, Chevigny-Saint-Sauveur; Luc Moreau; Daniel Nourry, both of Dijon; Serge Paggi, Ruffey Les Echirey, all of France

[73] Assignee: La Telemecanique Electrique, France

[21] Appl. No.: 130,344

[22] PCT Filed: Mar. 23, 1987

[86] PCT No.: PCT/FR87/00088

§ 371 Date: Dec. 17, 1987

§ 102(e) Date: Dec. 17, 1987

[87] PCT Pub. No.: WO87/05745

PCT Pub. Date: Sep. 24, 1987

[30] Foreign Application Priority Data

Mar. 21, 1986 [FR] France ..... 86 04042

[51] Int. Cl.[4] ..... H01H 33/06; H01H 9/32

[52] U.S. Cl. ..... 200/151

[58] Field of Search ..... 200/151

[56] References Cited

U.S. PATENT DOCUMENTS

| | | | |
|---|---|---|---|
| 3,576,967 | 5/1971 | Jeffries | 200/151 |
| 4,647,741 | 3/1987 | Belbel et al. | 200/151 |
| 4,659,887 | 4/1987 | Belbel et al. | 200/151 |

FOREIGN PATENT DOCUMENTS

| | | | |
|---|---|---|---|
| 0118334 | 12/1984 | European Pat. Off. | 200/151 |
| 0161120 | 11/1985 | European Pat. Off. | 200/151 |
| 0185576 | 6/1986 | European Pat. Off. | 200/151 |
| 2563939 | 11/1985 | France | 200/151 |
| 429879 | 8/1967 | Switzerland | 200/151 |

*Primary Examiner*—Robert S. Macon

*Attorney, Agent, or Firm*—William A. Drucker

[57] ABSTRACT

Electromechanical protection cutting apparatus comprising a magnetic tripping device and an arc-breaking screen which may be interleaved between at least one fixed contact and one movable contact during an opening caused by the tripping device. The stop (24) associated with the casing (11) of the apparatus to receive the breaking screen (12) is deformable and so arranged as not to restore immediately to the screen the kinetic energy received therefrom.

7 Claims, 1 Drawing Sheet

PROTECTION CUTTING APPARATUS PROVIDED WITH AN ARC BREAKING SCREEN

The present invention relates to an electromechanical protection switching apparatus with current threshold.

Such a switching apparatus is described in French Pat. No. 2 563 939. It includes in a case a breakable electric circuit which includes a magnetic trip, at least on separable fixed contact and mobile contact, as well as an arc breaking screen interposable between the contacts during a separation thereof caused by the actuation of the magnetic trip in response to an overcurrent or a short circuit. In French Pat. No. 2 540 665, such a device is also described in which the screen has a front surface able to be applied at the end of travel against a stop of the case.

Such switching apparatus operate satisfactorily. However, it can be observed that the arc breaking screen is projected at high speed towards its stop by the plunger of the magnetic trip. It reaches its stop with a very high speed, sometimes greater than 20 m/s and with keen acceleration capable of exceeding 400 g. This is observed particularly at the periphery of rotary breaking screens.

The screen risks then either breaking the stop or being itself broken. If the screen and/or its stop are reinforced, the screen risks bouncing and letting the arc phenomenon continue to exist, which adversely affects the operation of the apparatus and its lifespan. In addition, such reinforcement causes an increase of size, which is undesirable in the case of modular apparatus.

The purpose of the invention is to overcome these drawbacks and to prevent the continuation of the arc phenomenon as soon as this latter has been destabilized by the breaking screen, using simple, compact and efficient means. It also aims at integrating these means simply in the case of the apparatus. In accordance with the invention, the stop associated with the case for receiving the breaking screen is deformable. The stop is preferably at least partly resilient and adapted so as not to restore immediately to the breaking screen the kinetic energy received therefrom, the delay in restoring this energy being determined so that return of the screen only takes place after total extinction of the arc.

The stop may advantageously be attached to a part of the case of the apparatus and be integrally molded therewith; to balance the reaction on the screen, two deformable stops are preferably provided disposed opposite each other on two mutually assemblable parts of the case.

The deformable stop may have at least two zones of different resilience, the zone of highest resilience receiving the impact of the screen and being applied on the zone of lower resilience, so as to ensure a graduated deceleration of the screen. When the breaking screen is of the rotary type, the stop is preferably disposed between the periphery of the screen and the axis of rotation thereof, while being close to the striking center of the screen, so as to attenuate the reaction on the pivots of the screen.

Other features and advantages of the invention appear in greater detail from the following description.

In the accompanying drawings:

FIG. 1 shows, on a larger scale, the detail A of FIG. 1;

Figure 1:
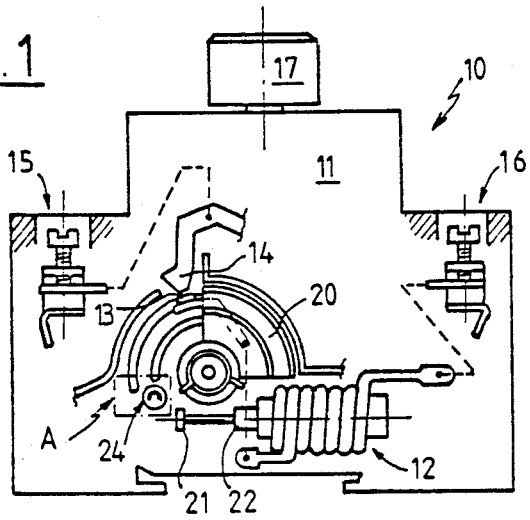
FIG. 1 shows schematically, in elevation, a switching apparatus having an arc breaking screen and a deformable screen stop in accordance with the invention.

The switching apparatus 10 shown in FIG. 1 is an isolating cut-out switch including a case 11 and, in this case, a breakable electric circuit which includes a magnetic trip 12, as well as a fixed contact 13 and a mobile contact 14. Apparatus 10, which could also be a contact breaker or contact maker-breaker, controls an external circuit capable of being connected to terminals 15, 16. The current flows, for example, from terminal 15 to terminal 16 through the mobile contact 14, the fixed contact 13 and the trip 12 via the connections shown with broken lines. Trip 12 acts on the mobile contact 14 via a lock, not shown, whereas a button or lever 17 makes it possible to open the contacts manually or to reset them. A thermal trip may also be provided for acting on the lock.

Figure 5:
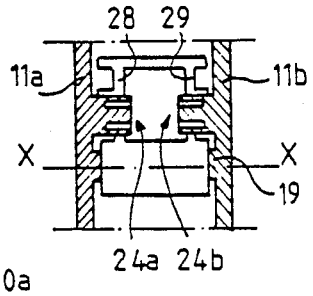
FIG. 5 is a partial section through the plane V—V of FIG. 4.
Figure 2:
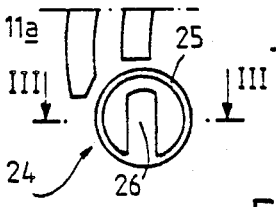
Figure 3:
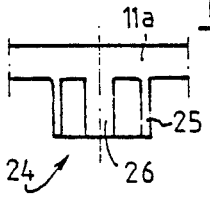
FIG. 3 is a sectional view through III—III of FIG. 2.
Figure 4:
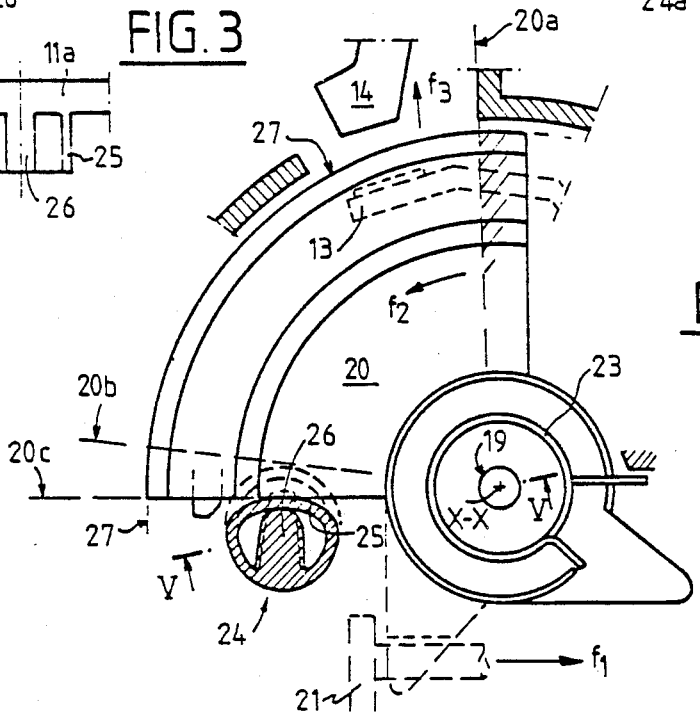
FIG. 4 shows on a larger scale the crushing of the stop by the screen.

A breaking screen 20 made from insulating material is mounted for rotation on pivots 19 with axis X—X in the case 11, (see FIGS. 4 and 5). Such a screen is described in French Pat. No. 2 563 939 and it may be actuated directly or indirectly by the magnetic trip 12 to come between the fixed 13 and mobile 14 contacts so as to contribute to drawing out, cooling and destabilizing the breaking arc. In the present embodiment, it is a question of direct drive by a tail 21 of the plunger 22 of trip 12.

The breaking screen 20 normally occupies a rest position **20*a* (FIG. 1 and in broken lines in FIG. 4) towards which it is returned by a torsion spring 23 and it is propellable by tail 21 of the magnetic trip 12 towards a resiliently deformable stop 24. Screen 20 reaches the stop in a contact making position 20*b* (FIG. 4) at a speed of the order of 20 m/s and with an acceleration greater than 200 g; it crushes the stop to reach the position 20*c* (FIG. 4). The respective movements of parts 21, 20 and 14 during opening are shown by the arrows $f_1$, $f_2$, $f_3$ in FIG. 4**.

Stop 24 is formed of a zone with relatively high resilience formed by a thin annular dividing wall 25 and a zone of relatively low resilience—or relatively rigid zone—formed by a solid stop 26. In the present example, the dividing wall 25 is attached to the foot of stop 26 so as to bend and be crushed thereon for compressing it as shown in FIG. 4. Zones 25, 26 could of course be disposed and arranged differently, so as to make a progressive deceleration of the screen possible in all cases and restoral thereto of its striking energy with a given delay guaranteeing that the return of the screen under the combined effect of this energy and that of the return spring 23 will only take place once the arc is extinguished.

The deformable stop 24 is preferably disposed between the periphery 27 of screen 20 and the axis X—X close to the striking center of the screen so as to attenuate the reaction on pivots 19.

The case may be formed of two mutually assemblable parts whose walls 11a, 11b are provided during molding with respective resiliently deformable stops **24*a*, 24*b* facing each other. The deformable stops cooperate with edges 28, 29 of the screen, substantially parallel to the walls 11*a*, 11*b*** forming a part of the front surface of the screen.

It goes without saying that modifications may be made to the embodiment described. Thus, the invention applies to switching apparatus with rectilinear moving arc breaking screens. The propulsion energy for the screen may, in some cases, be supplied by a resettable accumulator mechanism actuated by the magnetic trip.

What is claimed is:

1. Protection switching apparatus with current threshold including in a case (11) a breakable electric circuit which includes a trip (12), at least one fixed contact (13) and one mobile contact (14) which are separable, as well as an arc breaking screen (20) insertable between the contacts during a separation thereof caused by the actuation of the trip, the screen having a front surface capable of being applied at the end of travel against a stop (24) associated with the case, characterized by the fact that said stop (24) has at least two zones of different resilience, the breaking screen being applied in its breaking travel initially on the zone of highest resilience.

2. Apparatus according to claim 1, characterized by the fact that the stop (24) is directly attached to a part of the case (11) and integrally molded with this part.

3. Apparatus according to claim 1, characterized by the fact that two deformable stops (24*a*, 24*b*) are provided situated opposite each other on the walls (11*a*, 11*b*) of two mutually assemblable parts of the case (11).

4. Apparatus according to claim 3, characterized by the fact that the zone of highest resilience (25) of the stop is formed by an annular dividing wall of small thickness, whereas the zone of lowest resilience (26) of the stop is formed by a solid part, so that the annular dividing wall (25), when it is crushed by the screen (20), comes to bear on the solid part (26).

5. Apparatus according to claim 1, characterized by the fact that the arc breaking screen (20) is of the rotary type and the resiliently deformable stop (24) is disposed between the periphery of the screen and the axis of rotation thereof so as to be situated close to the striking center of the screen.

6. Apparatus according to claim 3, characterized by the fact that the zone of highest resilience (25) of the stop is formed by an annular dividing wall of small thickness, whereas the zone of lowest resilience (26) of the stop is formed by a solid part, so that the annular dividing wall (25), when it is crushed by the screen (20), comes to bear on the solid part (26).

7. Apparatus according to claim 6, characterized by the fact that the arc breaking screen (20) is of the rotary type and the resiliently deformable stop (24) is disposed between the periphery of the screen and the axis of rotation thereof so as to be situated close to the striking center of the screen.

* * * * *